US007117948B2

(12) United States Patent
Mazzella et al.

(10) Patent No.: US 7,117,948 B2
(45) Date of Patent: Oct. 10, 2006

(54) CONVERTIBLE JACK

(75) Inventors: Mark Mazzella, Washington, TX (US); Mike L. Smith, McAllen, TX (US); Stephen M. Burrow, Willis, TX (US); Brent S. Lim, Arlington, TX (US)

(73) Assignees: Varco I/P, Inc., Fort Worth, TX (US), part interest; Integrated Production Services LLC, Houston, TX (US), part interest ( * ) Notice: Subject to any disclaimer, the term of this patent is extended or adjusted under 35 U.S.C. 154(b) by 332 days.

(21) Appl. No.: 10/878,801

(22) Filed: Jun. 28, 2004

(65) Prior Publication Data

US 2004/0262015 A1 Dec. 30, 2004

Related U.S. Application Data

(60) Provisional application No. 60/483,496, filed on Jun. 27, 2003.

(51) Int. Cl.
*E21B 10/086* (2006.01)

(52) U.S. Cl. ..... 166/379; 166/77.4; 166/383

(58) Field of Classification Search ..... 166/379, 166/383, 77.4, 102
See application file for complete search history.

(56) References Cited

U.S. PATENT DOCUMENTS

| | | | | | |
|---|---|---|---|---|---|
| 2,126,933 | A | * | 8/1938 | Stone et al. | 166/77.4 |
| 3,096,075 | A | * | 7/1963 | Brown | 254/29 R |
| 3,999,610 | A | * | 12/1976 | Sage et al. | 166/383 |
| 4,119,297 | A | * | 10/1978 | Gunther | 254/29 R |
| 4,162,704 | A | * | 7/1979 | Gunther | 166/77.53 |
| 4,421,175 | A | * | 12/1983 | Boyadjieff et al. | 166/383 |
| 4,465,131 | A | * | 8/1984 | Boyadjieff et al. | 166/77.4 |
| 4,476,936 | A | * | 10/1984 | Boyadjieff et al. | 166/383 |
| 4,479,547 | A | * | 10/1984 | Boyadjieff et al. | 166/383 |
| 5,992,516 | A | * | 11/1999 | Palynchuk et al. | 166/77.2 |

* cited by examiner

*Primary Examiner*—Hoang Dang
(74) *Attorney, Agent, or Firm*—Bracewell & Giuliani LLP

(57) ABSTRACT

A snubbing unit for running and retrieving a string of tubing into a well under pressure selectively operates in a stand alone mode and a rig assist mode. The unit has a lower frame for mounting during the stand alone mode on a snubber blowout preventer. Stationary weight supporting slips and snubbing slips are carried by the lower frame during the stand alone mode. The unit has four hydraulic cylinders with weight supporting slips and snubbing slips carried by a traveling base plate on the piston rods. A stationary base plate is mounted between the lower frame and the traveling base plate. A spacer tube is connected to and between the lower frame and the stationary base plate in the stand alone mode. In the rig assist mode, the lower frame along with the stationary weight supporting slips and the spacer tube are removed to enable a rig blowout preventer to connect to the stationary base plate.

20 Claims, 2 Drawing Sheets

CONVERTIBLE JACK

CROSS-REFERENCE TO RELATED APPLICATION

This invention claims the benefit of U.S. provisional patent application 60/483,496 filed Jun. 27, 2003.

FIELD OF THE INVENTION

This invention relates in general to portable equipment for controlling oil and gas well pressure during an intervention operation, and in particular to a snubber or jack that is convertible from a stand-alone configuration to a rig-assist configuration.

BACKGROUND OF THE INVENTION

Many wells that produce oil and/or gas have sufficient internal pressure to flow the well fluid to the surface. The well has a casing and typically a string of tubing that extends downward through the casing. The well fluid flows up the tubing to a production tree at the surface. The tubing is supported by a tubing hanger that lands in the wellhead assembly.

For various reasons, the tubing must be pulled from time to time for remedial operations. Heavy liquid can be circulated into the well to overcome the internal formation pressure before pulling the tubing. However, in some instances killing the well in this manner can cause damage to the formation. In another procedure, rather than killing the well, the tubing is pulled and re-run while the well is still under pressure. The operator typically employs a snubbing unit to trip the tubing while under pressure.

A typical snubbing unit assembly operates with a blowout preventer ("BOP") that has an annular element that will seal around the tubing while it is being pulled or lowered. Often the pressure in a well may be sufficiently to push the tubing upward through the BOP, particularly when most of the tubing has been pulled from the well. The snubbing unit has at least one set of stationary slips that grip the tubing to prevent upward movement of the tubing and at least a set of traveling slips that grip the tubing to push it downward. Hydraulic cylinders stroke the traveling slips to push the tubing string downward while the blowout preventer is closed around the tubing.

Some snubbing units are constructed to operate independently of a workover rig. These stand alone units mount on top of a BOP to both pull and run the tubing. A weight supporting set of stationary and traveling slips are mounted to the unit for pulling the tubing. These stand alone units may also include a rotary mechanism for performing certain drilling and milling operations. In these units, a tubing guide may be employed to prevent buckling of the tubing.

Other snubbing units are constructed to operate in conjunction with a workover rig, and are referred to as rig assist units. A workover rig has a blowout preventer and a set of elevators and stationary slips to pull the tubing. However, a workover rig does not normally have snubbing slips to prevent upward movement of the tubing while pulling under pressure. Also, a workover rig does not normally have the ability to push the tubing into the well under high pressure. The rig assist unit has traveling and stationary snubbing slips and hydraulic cylinders that will accomplish these tasks. Because of space requirements and the lack of need, a rig assist unit would not have a number of items that a stand alone unit would have.

Service companies that provide snubbing units or jacks often have both stand-alone and rig assist snubbing units for the different customer needs. Maintaining both types of units adds expense and causes scheduling problems.

The snubbing units, whether rig assist or stand alone, normally have four hydraulic cylinders of the same diameter or pressure area. These cylinders will be rated to supply a selected amount of force. Deeper wells or wells with higher pressure may require higher capacity cylinders. Generally, the hydraulic pump and its associated components are matched to the capacity of the cylinders. A very high capacity jack will not be required on shallower wells and wells with lower pressure. Furthermore a very high capacity jack may be physically too large for smaller tasks or the stroking rate may be too slow. Consequently, an operator may have jacks of different capacities to match different customer needs. Additional sizes of jacks adds to inventory costs and create scheduling problems.

SUMMARY

The snubbing unit in one embodiment of this invention operates in a stand alone mode and a rig assist mode. In the stand alone mode, the unit has a lower frame for mounting on a snubber blowout preventer. The lower frame carries stationary weight supporting slips and stationary snubbing slips. Hydraulic cylinder assemblies extend upward from the lower frame and have a traveling base plate mounted to their upper ends. Traveling weight supporting slips and traveling snubbing slips are carried by the traveling base plate. A stationary base plate is mounted between the lower frame and the traveling base plate. A spacer tube connects and between the lower frame and the stationary base plate.

In the rig assist mode, the lower frame along with the stationary weight supporting slips and the spacer tube are removed to enable a rig blowout preventer to connect to the stationary base plate. The stationary snubbing slips are moved to the cylinder assemblies above the stationary base plate. Preferably a telescoping guide tube extends between the stationary base plate and the traveling base plate to prevent buckling of the tubing during insertion into the well under pressure. Optionally, the unit may also have a rotary drive during the stand alone mode. The guide tube in that instance has splines to transmit reactive torque to the spacer tube.

In another embodiment, the hydraulic cylinder assemblies comprise first and second pairs of hydraulic cylinder assemblies, the cylinder assemblies within each of the pairs being on opposite sides from each other of a longitudinal axis of the snubbing unit. A hydraulic fluid supply has a valve connected to a first set of lines leading to the first pair of the cylinder assemblies, and a second set of lines leading from the valve to the second pair of the cylinder assemblies. The valve has a first position wherein hydraulic fluid pressure is delivered to only the first pair of the cylinder assemblies and a second position wherein hydraulic fluid pressure is delivered to both of the pairs of the cylinder assemblies. Optionally, the cylinders within one pair may have smaller pressure areas than those of the other pair.

DETAILED DESCRIPTION OF THE INVENTION

Figure 1:
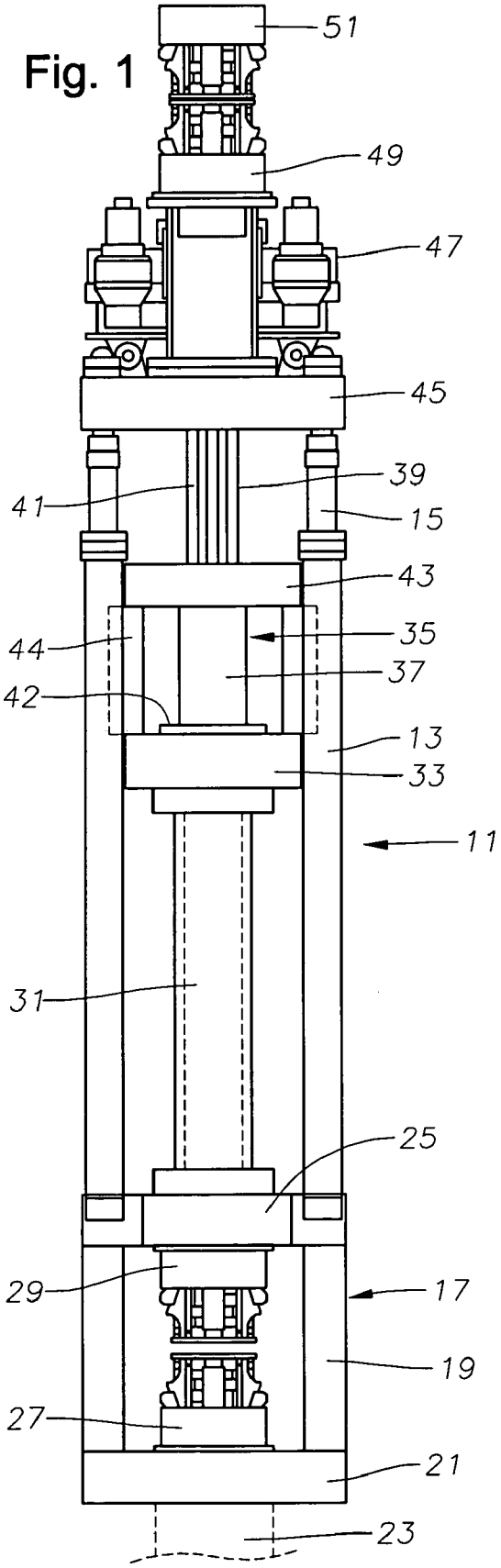
FIG. 1 is an elevational front view of a snubber or jack constructed in accordance with this invention and shown in a stand-alone configuration.
Figure 2:
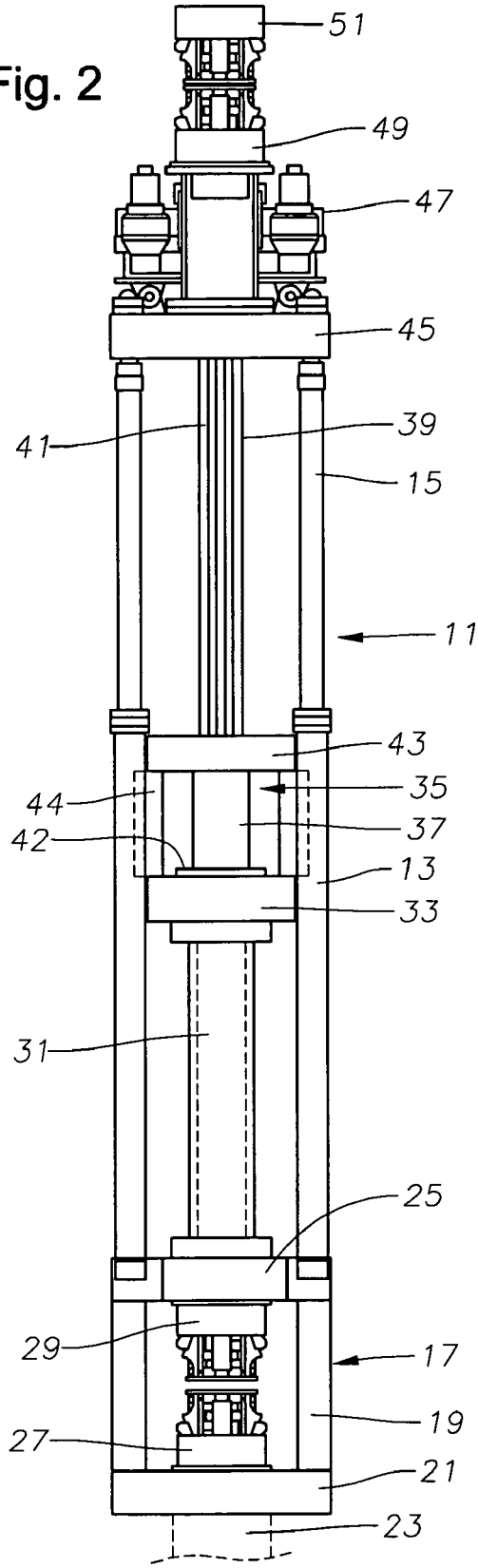
FIG. 2 is a reduced scale drawing of the jack of FIG. 1, and showing the jack extended from the position in FIG. 1.

A jack 11 is shown in a stand-alone configuration in FIG. 1. In this configuration, jack 11 is normally not used in conjunction with a workover or drilling rig. Jack 11 has four vertical cylinders 13 that are spaced apart from each other in a rectangular array. A piston rod 15 is reciprocally carried within each cylinder 13. FIG. 1 shows piston rods 15 in a retracted position, and FIG. 2 shows piston rods 15 in an extended position.

In the configuration of FIG. 1, cylinders 13 extend down to but are not connected to a slip window 17. Slip window 17 is a rectangular lower frame having four fixed length legs 19 (only two shown). The lower ends of legs 19 connect to a first or lower base plate 21 that is perpendicular to legs 19. Base plate 21 is a flat plate that bolts to an upper end of a conventional blowout preventer ("BOP") 23, which is typically brought to the well site with jack 11 while operating in a stand alone mode. Base plate 21 has a central opening (not shown) that communicates with the interior of BOP 23 for the passage of production tubing (not shown). BOP 23 is shown schematically and includes seal members that will close around the production tubing of the well as it is being withdrawn and run. The various seal members provide sealing while the tubing is moving through BOP 23, as well as providing a full closure when the tubing is not extending through BOP 23. BOP 23 couples to the upper end of a wellhead that is undergoing an intervention operation.

A second base plate 25 is mounted to the upper ends of legs 19, forming an upper end of slip window 17. Second base plate 25 is also a flat plate having a central aperture (not shown) and is parallel to first base plate 21. A set of stationary heavy slips 27 is mounted to the upper side of first base plate 21. The term "heavy" is used herein to mean that slips 27 support the weight of tubing, and does not refer to the particular capacity of slips 27. A set of stationary snubbing slips 29 is mounted to the lower side of second base plate 25. The term "snubbing" is used herein to mean slips that will grip tubing to prevent upward movement of the tubing. Both sets of slips 27, 29 are hydraulically actuated between a retracted position and an engaged position. While in the engaged position, stationary heavy slips 27 will support the weight of a tubing string that is in the process of being lowered into or pulled from the well. Stationary snubbing slips 29 are constructed in the same manner as stationary heavy slips 27, but inverted, so that when engaged, they will prevent the tubing string from moving upward as a result of high pressure in the well tending to push the production tubing from the well.

In the stand alone mode, a spacer tube or spool 31 mounts to the upper side of second base plate 25 and extends upward to a third base plate 33, which is stationary. Spacer spool 31 is a tubular member of fixed length. Spacer spool 31 will transmit any downward directed load on third base plate 33 downward to slip window 17. Third base plate 33 is stationarily mounted to the upper end of spacer spool 31 and is stationary to relative to cylinders 13. Cylinders 13 may be clamped to third base plate 33 to retain them in a vertical orientation. There are no legs extending between third base plate 33 and lower frame 17, rather the only connection is though spacer spool 31.

In the stand alone mode, a torque tube or guide tube 35 is mounted to the upper side of a snub plate 43. Torque tube 35 comprises an outer tubular member 37 that is stationary relative to cylinders 13 and an inner tubular member 39 that telescopes within outer tubular member 37. Coaxial splines 41 are located on the exterior of inner tubular member 39 and in the interior of outer tubular member 37 so that any torque imposed on inner tubular member 39 transmits to outer tubular member 37. Outer tubular member 37 has a flange 42 that extends radially outward for receiving fasteners for bolting outer tubular member 37 to the upper side of snub plate 43. Consequently, any torque imposed on outer tubular member 37 transmits to snub plate 43, and from there through third base plate 33 and spool 31 to slip window 17 and BOP 23. Although torque tube 35 transmits torque, the torque is reactive because torque tube 35 does not rotate. A portion of outer member 37 extends into the interior of spacer spool 31. A portion of inner member 39 will extend into the interior of spacer spool 31 while torque tube 35 is in the retracted position. If the operator did not plan on drilling or milling operations, splines 41 could be eliminated, in which case torque tube 35 would serve to constrain the tubing to prevent buckling.

Snub plate 43 is secured to third base plate 33 by four legs 44 (two are schematically shown) that are similar to legs 19 of slip window member 17. Third base plate 33 and snub plate 43 are thus at fixed distances relative to each other and make up an upper frame that is similar in dimensions to lower frame 17. The upper ends of cylinders 13 are secured to upper frame legs 44 for stability and to transmit axial loads to snub plate 43 and third base plate 33. The upper end of outer tubular member 37 of torque tube 35 extends up to and is bolted snub plate 43.

A traveling base plate or head 45 is mounted to the upper ends of piston rods 15, thus moves vertically relative to base plates 21, 33 and 43. Traveling head 45 is a flat plate having a central aperture through it for receiving inner tubular member 39 of torque tube 35. The upper end of inner tubular member 39 of torque tube 35 bolts to traveling head 45.

A rotary drive unit 47 is mounted to the upper side of traveling head 45. Rotary drive unit 47 is preferably hydraulically driven and is used for performing certain drilling tasks that may be encountered or other rotational needs. Rotary drive unit 47 has bearings to allow rotation relative to traveling head 47 and a lock to prevent such as desired A set of traveling heavy slips 49 is mounted to the rotary power unit 47 for rotation therewith. Traveling heavy slips 49 face upward for supporting the weight of a string of pipe extending through it. A set of traveling snubbing slips 51 mount to the upper end of traveling heavy slips 49. Traveling snubbing slips 51 are inverted relative to heavy slips 49 so as to grip and force tubing downward when piston rods 15 are retracted. Slips 49, 51 rotate with rotary power unit 47 and move axially with piston rods 15. If the operator did not desire a rotary drive unit 47, traveling slips 49 and 51 would be mounted directly to traveling head 45.

In the stand alone mode, jack 11 is typically used to pull and run production tubing while the well remains under pressure. Normally, jack 11 is taken to a well site on a truck, then erected with its BOP 23 mounted to the upper portion of the tubing head or wellhead that supports the string of production tubing. This portion of the wellhead will contain valves above the tubing hanger that will have been closed to contain the pressure of the well. Once BOP 23 is installed, the pressure will be safely constrained by BOP 23, enabling the valves of the wellhead to open.

To pull the production tubing, the operator operates jack 11 in a conventional manner. The lower end of the production tubing is closed by a plug, valve or sliding sleeve and the pressure in the tubing relieved. Pressure in the tubing annulus surrounding the tubing still remains, however. The operator pulls the production tubing one joint or section at a time by extending piston rods 15 while keeping the BOP 23 closed around the tubing to contain the tubing annulus pressure. The operator will employ tubing tongs (not shown) from a work basket area located on the upper end of jack 11 to unscrew each joint, then return piston rods 15 to the retracted position for another joint. As each joint is pulled, piston rods 15 will move from the retracted position in FIG. 1 to the extended position in FIG. 2.

If the tubing string is sufficiently heavy, heavy traveling slips 49 support the weight of the tubing string while piston rods 15 are extending. Similarly, heavy stationary slips 27 support the weight of a heavy tubing string while piston rods 15 are retracting for engaging a new section of tubing. The downward load path while piston rods 15 are extending runs from piston rods 15 to snub plate 43, legs 44, third base plate 33, spacer spool 31, slip window 17 and BOP 23 to the wellhead.

If the weight of the tubing string is or becomes insufficient to withstand the force of the well pressure pushing the tubing string upward, traveling snubbing slips 51 counter the upward force on the tubing while piston rods 15 are extending. Stationary snubbing slips 29 grip the tubing to prevent any upward movement while piston rods 15 are retracting for a new section of tubing. The upward load path is the same as above, with the upward load force being transmitted to the wellhead.

When the tubing is light while tubing is moving upward, stationary snubbing slips 29 will be in a retracted position while traveling snubbing slips 51 will normally be in an engaged position. Similarly while pulling tubing upward when the tubing is heavy, stationary heavy slips 27 will be in a retracted position and traveling heavy slips 49 will be engaged. Consequently, as piston rods 15 advance tubing upward, stationary slips 27 or 29 are normally retracted and traveling slips 49 or 51 are normally in engagement with the tubing.

When running the tubing back into the well, the reverse process is employed. The traveling slips 49 or 51 will be actuated into engagement with the tubing and power supplied to cylinders 13 to stroke the piston rods 15 back downward. If the tubing string is lighter than the force exerted by well pressure, traveling snubbing slips 51 will apply force to the string of tubing to push it back into the well. By enclosing the tubing, torque tube 35 reduces the chances for the tubing to buckle when being pushed back into the well.

The operator may wish to utilize the tubing and jack 11 to drill out sections of the well, such as a temporary plug that may have been set. The operator performs drilling with rotary unit 47, which rotates traveling slips 49, 51, thereby rotating the tubing when engaged. Reaction against the torque passes through splines 41 of torque tube 35 to spacer spool 31, slip window 17 and BOP 23.

When jack 11 is to be used in conjunction with a drilling rig or workover rig, it will normally not perform drilling operations. Also, jack 11 will not normally need to support the weight of the pipe with heavy slips 27, 49 because the rig will have elevators to pull tubing and slips for supporting the weight of the tubing. Rather, while in the rig assist configuration, jack 11 is used primarily to run tubing while the well is under pressure. Typically, the workover rig will not have slips that prevent upward movement of tubing due to well pressure. The workover rig typically will have its own BOP 23, which may have been installed before jack 11 reached the well site because of earlier operations. Alternately, jack 11 could provide the BOP 23.

Figure 3:
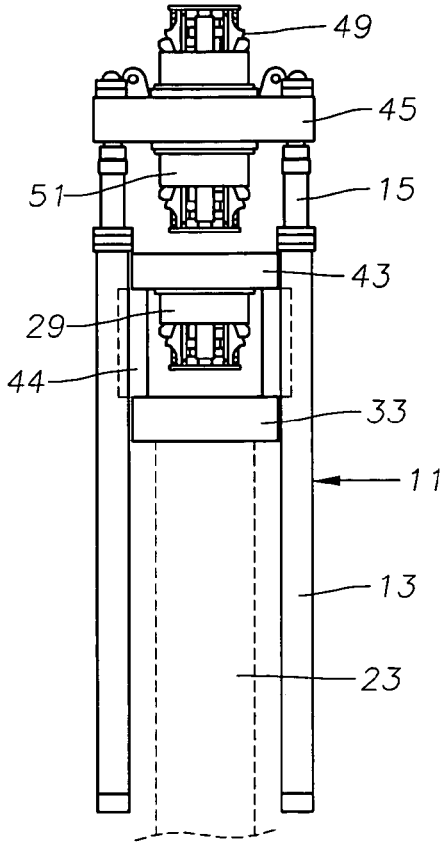
FIG. 3 is an elevational view of the jack in FIG. 1, shown in a rig assist configuration.

Referring to FIG. 3, to convert jack 11 to the rig assist configuration, slip window 17 is removed along with stationary heavy slips 27 and stationary snubbing slips 29. The first and second base plates 21, 25 are removed along with slip window 17. Spacer spool 31 is removed from its attachment to stationary base plate 33. The removal of base plates 21, 25 and spacer spool 31 provides a space below third base plate 33 between cylinders 13 for BOP 23. BOP 23 bolts in this location to the lower side of third base plate 33. Torque tube 35 is preferably removed, and stationary snubbing slips 29 are secured to the lower side of snub plate 43. The operator also removes rotary power unit 47. The operator installs traveling snubbing slips 51 on the lower side of traveling head 45. Heavy traveling slips 49 optionally may be mounted to the upper side of traveling head 45. Cylinders 13 will extend around BOP 23 and need not have their lower ends in contact with any supporting structure. The overall height of jack 11 while pistons 15 are retracted is considerably reduced when converting from the stand alone mode to the rig assist mode.

In the operation of jack 11 in the rig assist mode as configured in FIG. 3, the operator will run tubing back through BOP 23 while the well is under pressure in the same manner as in FIG. 1. The lower end of the tubing will be closed with a valve, plug or sliding sleeve. On the downstroke, stationary snubbing slips 29 are retracted while traveling snubbing slips 51 or heavy snubbing slips 49 engage the tubing. If the tubing string is too light to move downward of its own weight, traveling snubbing slips 51 and the downward force imposed by piston rods 15 push the string of tubing downward. If the string of tubing is or becomes heavy enough to move downward of its own weight, traveling heavy slips 49 may support the weight of the tubing string as it moves downward. If traveling heavy slips 49 are not used, the rig elevators can be used to lower the tubing string. At the end of each downstroke, the operator grips the tubing with stationary slips 29 to prevent the tubing from being moved upward while traveling slips 49, 51 move back upward. If the string of tubing is heavier than the force pushing upward, the rig slips are employed to hold the weight of the string as the piston rods 15 move back upward.

Figure 4:
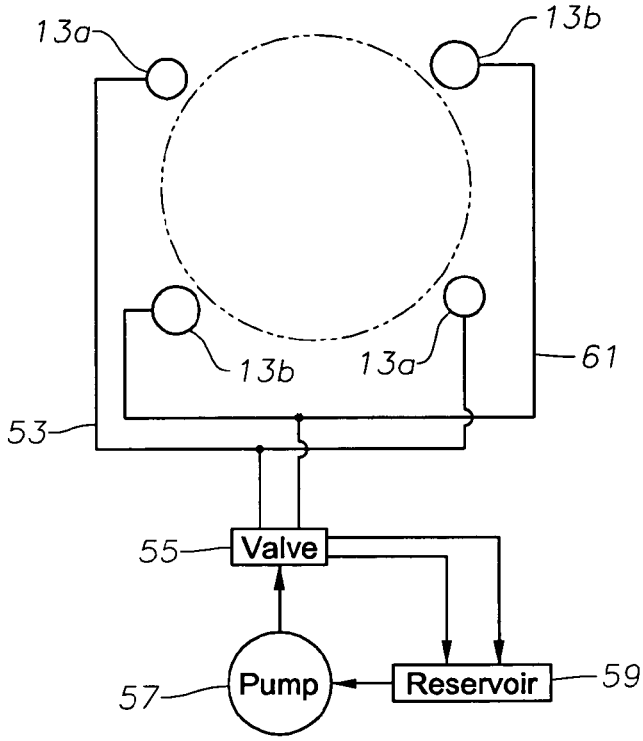
FIG. 4 is a schematic view of one embodiment of the hydraulic cylinders and associated equipment for the jack of FIG. 1, with two of the cylinders being of larger diameter than the other two.

Referring to FIG. 4, jack 11 may be configured with one pair of cylinders 13*a* of smaller pressure area or diameter than the other pair of cylinders 13*b*. Each cylinder 13*a* is opposite the other cylinder 13*a*, or 180 degrees apart relative to a longitudinal axis of jack 11. Because two pairs 13*a*, 13*b*, are employed, cylinders 13*a* are diagonal from each other, and cylinders 13*b* are diagonal from each other. Smaller diameter cylinders 13*a* have lower force capacities, but will cause more rapid movement of piston rods 15 for the same flow rate of hydraulic fluid than the larger diameter cylinders 13*b*. Larger diameter cylinders 13*b* have greater pressure areas to exert more force for the same rate and pressure of hydraulic fluid being supplied. In some cases, only two cylinders are needed to pull or run the tubing, rather than all four. The arrangement of FIG. 4 allows two cylinders to be employed, or all four cylinders to be employed. This option is accommodated by lines 53 that are in parallel with cylinders 13*a*. Lines 53 extend to a valve 55 that is connected to hydraulic pump 57. Hydraulic pump 57 draws hydraulic fluid from the reservoir 59.

Similarly, hydraulic lines 61 extend in parallel from larger diameter cylinders 13*b*. Lines 61 also extend to valve 55, pump 57 and reservoir 59. Valve 55 is a multi-position valve that causes pump 57 to supply hydraulic fluid pressure in one of three modes. In the first mode, valve 55 causes fluid pressure to flow through lines 53 and 61 to all of the cylinders 13*a* and 13*b*. In the second mode, valve 55 causes fluid pressure to flow only through line 53 to smaller diameter cylinders 13*a*. In the third mode, valve 55 causes hydraulic fluid pressure to flow only to the larger diameter cylinders 13*b*.

Figure 5:
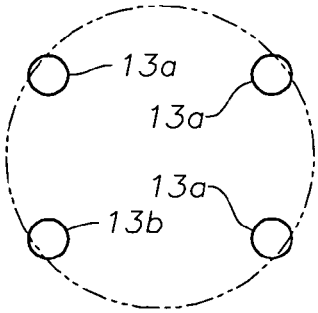
FIG. 5 is a schematic view similar to the hydraulic cylinders of FIG. 4, except all of the cylinders are of smaller diameter.
Figure 6:
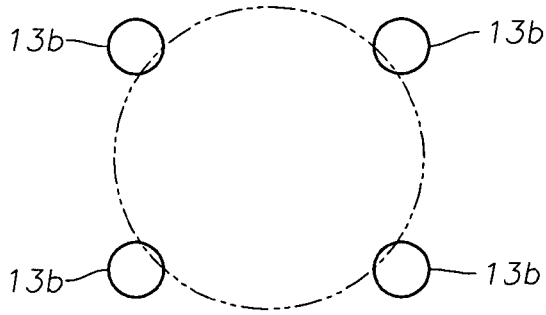
FIG. 6 is a schematic view similar to FIG. 5, except all of the cylinders are of larger diameter.

FIG. 5 illustrates that in addition to operating with two diameters of cylinders, all of the cylinders 13*a* can be of smaller diameter. Cylinders 13*a* and 13*b* are readily removable from base plates 25, 27 and 43 (FIG. 1). The operator can also convert all of the cylinders 13*a* to larger diameter cylinders 13*b* as shown in FIG. 6. The largest capacity unit would employ all four cylinders 13*b* while the smallest capacity would employ only smaller diameter cylinders 13*a*.

The invention has significant advantages. The jack assembly readily converts from a stand alone mode to a rig assist mode. This allows an operator to accommodate different types of service work with only one unit. The speed of the strokes can be optimized for lighter and heavier tubing strings by switching a valve to utilize fewer piston cylinders in one embodiment . In another embodiment, the stroke speed or lifting capacity may be changed by switching out different diameters of pistons.

While the invention has been shown in only a few of its forms, it should be apparent to those skilled in the art that it is not so limited but is susceptible to various changes without departing from the scope of the invention.

We claim:

1. A snubbing unit for selectively pulling and running a string of tubing in a well under pressure in a stand alone mode and a rig assist mode, comprising:

a lower frame for mounting during the stand alone mode on a snubber blowout preventer that is sealable around the tubing;

stationary weight supporting slips and stationary snubbing slips carried by the lower frame during the stand alone mode;

a plurality of hydraulic cylinder assemblies extending upward from the lower frame during the stand alone mode;

a traveling base plate mounted to upper ends of the hydraulic cylinder assembles for upward and downward stroking movement with the upper ends of the hydraulic cylinder assemblies;

traveling weight supporting slips and traveling snubbing slips carried by the traveling base plate during the stand along mode for movement therewith;

a spacer tube connected to and extending upward from the lower frame in the stand alone mode;

a stationary base plate below the traveling base plate, the spacer tube having an upper end connected to the stationary base plate; and wherein in the rig assist mode, the lower frame along with the stationary weight supporting slips and the spacer tube are removed to enable a rig blowout preventer to connect to the stationary base plate, and the stationary snubbing slips are carried by the cylinder assemblies above the stationary base plate.

2. The snubbing unit according to claim 1, further comprising a telescoping guide tube mounted to the stationary base plate for receiving the tubing and preventing buckling of the tubing while the traveling snubbing slips are pushing the tubing downward.

3. The snubbing unit according to claim 1, further comprising:

a second stationary base plate mounted to the hydraulic cylinder assemblies a fixed distance above the first mentioned stationary base plate; and wherein in the rig assist mode, the stationary snubbing slips mount to the second stationary base plate.

4. The snubbing unit according to claim 1, further comprising:

a rotary drive unit carried by the traveling base plate for selectively rotating the traveling snubbing slips to rotate the tubing.

5. The snubbing unit according to claim 4, further comprising:

a telescoping torque tube having an upper portion that moves with the traveling base plate and a lower portion that is stationary relative to the stationary base plate, the torque tube having mating spline members for transferring reactive torque imposed by the rotary drive unit through the lower portion and stationary base plate to the spacer tube.

6. The snubbing unit according to claim 1, wherein:

each of the hydraulic cylinder assemblies comprises a piston rod that strokes within a cylinder;

the traveling base plate is rigidly mounted to the piston rods; and an axial load path extends from the cylinders through the stationary base plate to the spacer tube.

7. The snubbing unit according to claim 1, wherein:

the plurality of hydraulic cylinder assemblies comprise first and second pairs of hydraulic cylinder assemblies, the cylinder assemblies within each of the pairs being on opposite sides from each other of a longitudinal axis of the snubbing unit; and wherein the snubbing unit further comprises:

a hydraulic fluid supply for supplying hydraulic fluid under pressure;

a valve connected to the hydraulic fluid supply;

a first set of lines leading from the valve to the first pair of the cylinder assemblies, and a second set of lines leading from the valve to the second pair of the cylinder assemblies; and wherein the valve has a first position wherein hydraulic fluid pressure is delivered to only the first pair of the cylinder assemblies and a second position wherein hydraulic fluid pressure is delivered to both of the pairs of the cylinder assemblies.

8. The snubbing unit according to claim 1, wherein:

the first pair of the cylinder assemblies has cylinders of smaller pressure areas than cylinders of the second pair of the cylinder assemblies; and the valve has a third position wherein hydraulic fluid pressure is delivered to only to the second pair of the cylinder assemblies.

9. A snubbing unit for running a string of tubing into a well under pressure in a stand alone mode and in a rig assist mode, the unit in the stand alone mode comprising:

first and second stationary base plates mounted a fixed vertical distance apart from each other, the first stationary base plate adapted to mount to a snubber blowout preventer that is sealable around the tubing;

a set of stationary weight supporting slips carried by one of the stationary base plates to grip and prevent downward movement of the tubing due to weight of the tubing;

a set of stationary snubbing slips carried by the other of the stationary base plates to grip and prevent upward movement of the tubing due to pressure in the well;

a plurality of hydraulic cylinders extending upward from the second stationary base plate, each of the cylinders having a piston rod;

a removable spacer tube releasably connected to and extending upward from the second stationary base plate;

a third stationary base plate carried by the cylinders, the spacer tube having an upper end connected to the stationary base plate;

a traveling base plate mounted to the piston rods of the cylinders for upward and downward stroking movement with the piston rods;

a telescoping guide tube having a lower end carried by the third stationary base plate and an upper end carried by the traveling base plate for movement therewith;

a set of traveling weight supporting slips carried by the traveling base plate for movement therewith, the traveling weight supporting slips being oriented for gripping the tubing to prevent downward movement of the tubing relative to the traveling base plate due to weight of the tubing;

a set of traveling snubbing slips carried by the traveling base plate for movement therewith, the traveling snubbing slips being oriented for gripping the tubing and pushing the tubing downward as the traveling base plate strokes downward; and wherein during the rig assist mode, the first and second stationary base plates and the spacer tube are removed for connecting a rig blowout preventer to the third stationary base plate, the telescoping guide tube is removed, and the stationary snubbing slips are stationarily mounted above the third stationary base plate.

10. The snubbing unit according to claim 9, further comprising a rotary drive unit carried by the traveling base plate for selectively rotating the tubing.

11. The snubbing unit according to claim 9, wherein the telescoping guide tube has splines for transferring reactive torque from the rotary drive unit to the spacer tube.

12. The snubbing unit according to claim 9, wherein:

the plurality of hydraulic cylinders comprise first and second pairs of hydraulic cylinders, each the cylinders within each of the pairs being arranged 180 degrees apart from the other cylinder within the same pair around a longitudinal axis of the snubbing unit; and wherein the snubbing unit further comprises:

a hydraulic fluid supply for supplying hydraulic fluid under pressure;

a valve connected to the hydraulic fluid supply;

a first set of lines leading from the valve to the first pair of the cylinders, and a second set of lines leading from the valve to the second pair of the cylinders; and wherein the valve has a first position wherein hydraulic fluid pressure is delivered to only the first pair of the cylinders and a second position wherein hydraulic fluid pressure is delivered to both of the pairs of the cylinders.

13. The snubbing unit according to claim 9, wherein:

the first pair of the cylinders has a smaller pressure area than the second pair of the cylinders; and the valve has a third position wherein hydraulic fluid pressure is delivered only to the second pair of the cylinders.

14. A snubbing unit for running a string of tubing into a well under pressure, comprising:

a frame;

a set of stationary slips carried by the frame for gripping tubing to prevent upward movement of the tubing relative to the frame;

first and second pairs of hydraulic cylinder assemblies, the cylinder assemblies within each of the pairs being arranged opposite each other relative to a longitudinal axis of the snubbing unit;

a hydraulic fluid supply for supplying hydraulic fluid under pressure;

a valve connected to the hydraulic fluid supply;

a first set of lines leading from the valve to the first pair of the cylinder assemblies, and a second set of lines leading from the valve to the second pair of the cylinder assemblies; and wherein the valve has a first position wherein hydraulic fluid pressure is delivered to only the first pair of the cylinder assemblies and a second position wherein hydraulic fluid pressure is delivered to both of the pairs of the cylinders assemblies;

a traveling base plate carried by traveling upper portions of the first and second pairs of cylinder assemblies; and a set of traveling snubbing slips carried by the traveling base plate for gripping tubing for movement therewith, the traveling snubbing slips being oriented for gripping the tubing and pushing the tubing downward as the traveling base plate strokes downward.

15. The snubbing unit according to claim 14, wherein:

the first pair of the cylinders has a smaller pressure area than the second pair of the cylinder assemblies; and the valve has a third position wherein hydraulic fluid pressure is delivered only to the second pair of the cylinder assemblies.

16. A method of operating a snubbing unit selectively in a stand alone mode and a rig assist mode, the method comprising in the stand alone mode:

(a) providing a lower frame with weight supporting and snubbing stationary slips, a plurality of hydraulic cylinder assemblies, weight supporting and snubbing traveling slips on the upper ends of the cylinder assemblies, a stationary base plate between the lower frame and the traveling slips, and a spacer tube between the lower frame and the stationary base plate;

(b) connecting the lower frame to a snubber blowout preventer;

(c) stroking the cylinder assemblies to pull and run tubing through the spacer tube and with the stationary and traveling slips while with the snubber blowout preventer is closed; and to operate the snubbing unit during the rig assist mode, (d) removing the lower frame along with the stationary slips and the spacer tube, and mounting the stationary snubber slips above the stationary base plate;

(e) connecting the stationary base plate to a rig blowout preventer; then (f) stroking the cylinder assemblies to run tubing with the stationary and traveling snubbing slips.

17. The method according to claim 16, wherein the method in the stand alone mode further comprises:

mounting a telescoping guide tube between the stationary base plate and the traveling slips; and passing the tubing through the guide tube to prevent buckling while running the tubing.

18. The method according to claim 16, wherein the method in the stand along mode further comprises:

mounting a rotary drive unit to the upper ends of the cylinders and a telescoping torque tube between the rotary drive unit and the stationary base plate; and rotating the tubing with the rotary drive unit and reacting torque through the telescoping torque tube to the stationary base plate, and from the stationary base plate through the spacer tube to the snubber blowout preventer.

19. The method according to claim 16, wherein:

step (a) comprises providing two pair of the hydraulic cylinder assembles, each cylinder assembly within each of the pairs being spaced opposite the other cylinder assembly within the same pair relative to a longitudinal axis of the unit; and step (c) comprises supplying hydraulic pressure selectively to only one of the pairs to stroke the cylinder assemblies.

20. The method according to claim 16, wherein:

step (a) further comprises providing one of the pairs with cylinders of larger pressure area than the cylinders of the other pair.

* * * * *